US007417589B2

(12) United States Patent
Sullivan et al.

(10) Patent No.: US 7,417,589 B2
(45) Date of Patent: Aug. 26, 2008

(54) NANO ANTENNA

(75) Inventors: Jonathan L. Sullivan, Lincoln, NE (US); Robert Slawinski, Lincoln, NE (US); Edward Carter, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 220 days.

(21) Appl. No.: 11/278,707

(22) Filed: Apr. 5, 2006

(65) Prior Publication Data

US 2007/0236395 A1 Oct. 11, 2007

(51) Int. Cl.
*H01Q 1/38* (2006.01)
*H01Q 1/36* (2006.01)

(52) U.S. Cl. ..... 343/700 MS; 343/895

(58) Field of Classification Search ..... 343/700 MS, 343/702, 895

See application file for complete search history.

(56) References Cited

U.S. PATENT DOCUMENTS 6,166,694 A * 12/2000 Ying ..... 343/702
6,169,521 B1 * 1/2001 Kitamura ..... 343/702
6,900,768 B2 * 5/2005 Iguchi et al. ..... 343/702

* cited by examiner

*Primary Examiner*—Shih-Chao Chen
(74) *Attorney, Agent, or Firm*—Holland & Hart LLP

(57) ABSTRACT

An antenna for a wireless device is provided. The antenna mounts on a substrate such as a printed circuit board. The antenna includes a carrier having sidewalls with inside surfaces defining an internal recess. A conductive trace resides on the carrier. The conductive trace having a first end and a second end opposite the first end with at least one lead extending from an end and extending the sidewall. The lead terminates in a hook that traversing the sidewall and has a portion extending along the inside surface of the internal recess. A locking clip is sized to fit in the internal recess and frictionally lock the portion between an outside surface of the locking clip and the inside surface of the internal recess such that the locking clip locks the portion, the at least one hook, the at least one lead, and the conductive trace in position on the carrier.

25 Claims, 4 Drawing Sheets

NANO ANTENNA

FIELD OF THE INVENTION

The present invention relates to antennas and, more particularly, to a method and apparatus to assemble and antenna and to electrically connect an antenna to a substrate, such as a printed circuit board.

BACKGROUND OF THE INVENTION

Printed circuit, boards or substrates for wireless devices often have antennas mounted on them. Referring to FIG. 1, an antenna 100 mounted on a printed circuit board (PCB) 102 is shown. As is generally understood in the art, printed circuit board comprises a plurality of electronic circuits 101 on PCB 102 that may be connected to antenna 100 or other portions of the wireless device. Antenna 100 comprises a conductive trace 104, such as a cooper trace, supported by a carrier 106 such that conductive trace 104 resides above, and typically parallel, to the printed circuit board 102. Conductive trace 104 has a first end 108 and a second end 110 opposite first end 108 connected by a body 112. Leads 114 extend from printed circuit board 102 to conductive trace 104 to provide RF power and ground to antenna 100 or, in some instances, the pad on the antenna trace is connected to the printed circuit board for mechanical reasons only.

Conventionally, conductive trace 104 is attached to carrier 106 using an adhesive or the like. In some cases, the adhesive breaks down prior to antenna 100 being mounted on PCB 102. When the adhesive breaks down, conductive trace 104 may move or slide in relation to carrier 106. The movement may influence the electrical characteristics of antenna 100. Moreover, an electrical connection between printed circuit board 102 and leads 114 is formed by electrical connectors 118, such as, for example, press fit contacts or spring contacts. Movement of conductive trace 104 and/or leads 114 may inhibit the ability to connect antenna 100 to radio frequency power.

Against this background, an improved antenna is provided.

SUMMARY OF THE INVENTION

To attain the advantages and in accordance with the purpose of the invention, as embodied and broadly described herein, a device to electrically couple an antenna to a substrate is provided. The device comprises an antenna to mount on a substrate contained in a wireless device. The antenna includes a carrier having sidewalls with inside surfaces defining an internal recess. A conductive trace resides on the carrier. The conductive trace having a first end and a second end opposite the first end with at least one lead extending from an end and extending the sidewall. The lead terminates in a hook that traversing the sidewall and has a portion extending along the inside surface of the internal recess. A locking clip is sized to fit in the internal recess and frictionally lock the portion between an outside surface of the locking clip and the inside surface of the internal recess such that the locking clip locks the portion, the at least one hook, the at least one lead, and the conductive trace in position on the carrier.

The foregoing and other features, utilities and advantages of the invention will be apparent from the following more particular description of a preferred embodiment of the invention as illustrated in the accompanying drawings.

BRIEF DESCRIPTION OF THE DRAWINGS

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

The present invention will be described with reference to FIGS. 2-6. While the present invention is described in relation to a meanderline antenna structure residing on a dielectric carrier mounted to a printed circuit board, one of ordinary skill in the art would recognize or reading the disclosure that the invention has broader application limited only by the claims appended hereto.

Figure 1:
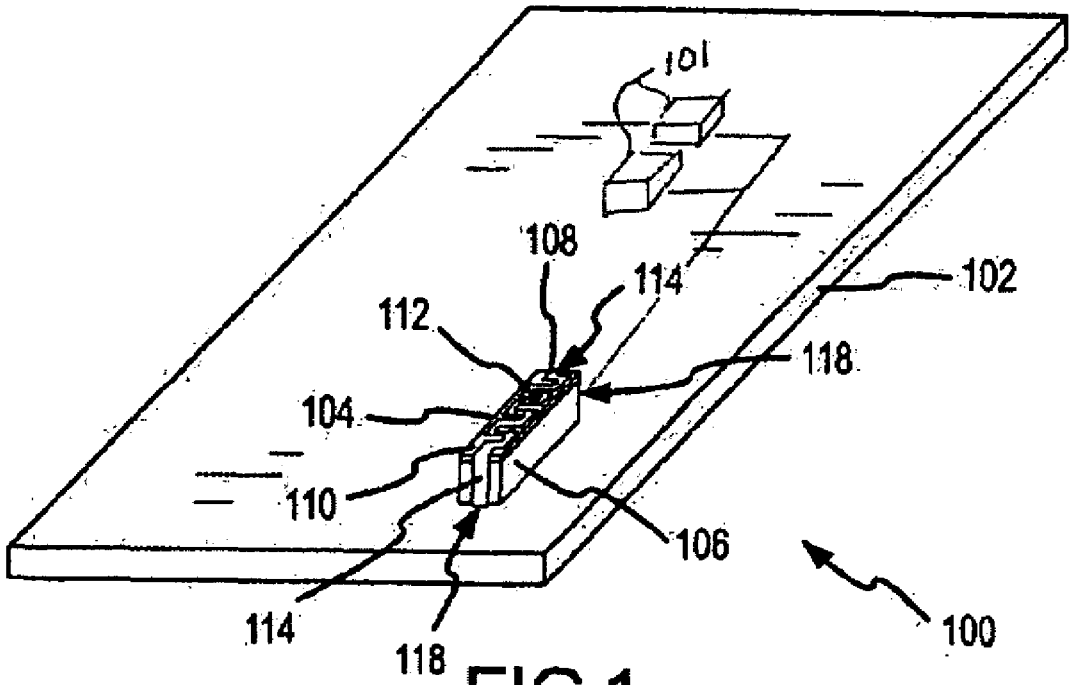
FIG. 1 PRIOR ART
FIG. 1 shows top perspective view of a printed circuit board with an antenna mounted thereon.
Figure 2:
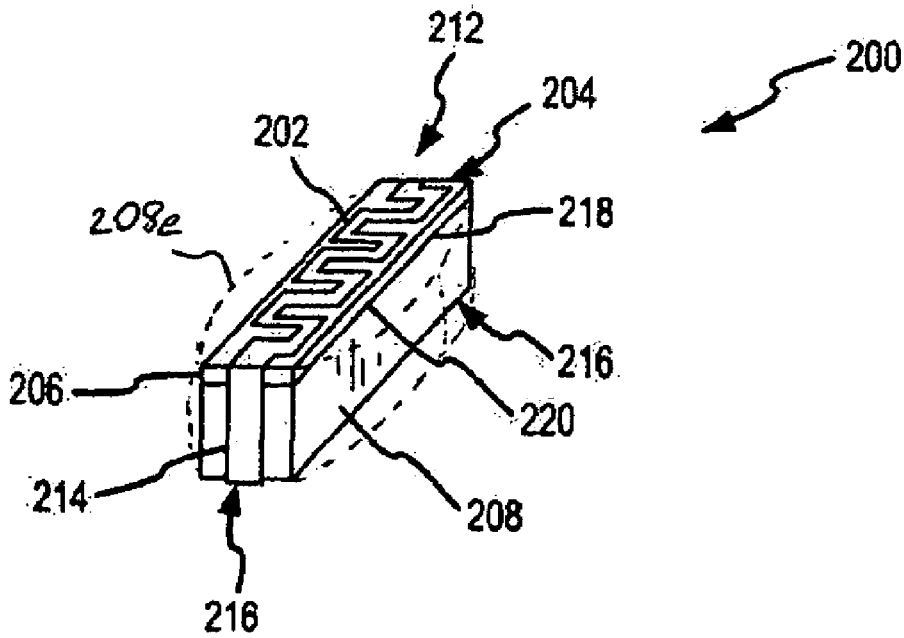
FIG. 2 shows a top perspective view of an antenna constructed in accordance with an embodiment of the present invention.
Figure 4:
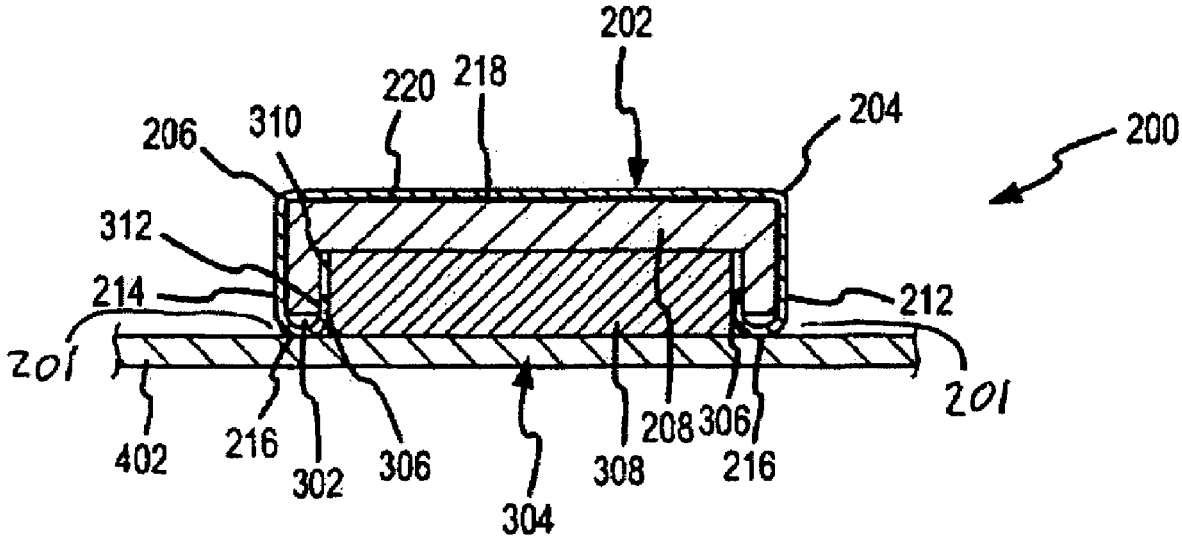
FIG. 4 shows a cross-sectional view of the antenna of FIG. 2.

Referring now to FIG. 2, an antenna 200 constructed in accordance with the present invention is shown. Antenna 200 includes a conductive trace 202, shown as a meanderline trace, having a first end 204 and a second end 206 opposite the first end. Conductive trace 202 resides on a carrier 208. Carrier 208 resides on a substrate (not shown in FIG. 2), such as printed circuit board 102 above. First lead 212 and second lead 214 extend from first end 204 and second end 206 respectively and terminate in hooks 216, the purpose of hooks 216 will be explained further below. A flexible film 218 may resides between conductive trace 202 and carrier 208 (i.e., a flexible film antenna). Flexible film 218 may be adhered to carrier 208 using an adhesive 220. If used, adhesive 220 may be contiguous as shown or non-contiguous. While carrier 208 is shown substantially rectangular, the shape could be any number of geometric shapes, such as, elliptical 208*e* as shown in phantom, or other shapes, such as, for example, circular, square, trapezoidal, oblong, etc., or even a random shape. FIG. 4 shows antenna 200 in a cross-sectional view.

Figure 3:
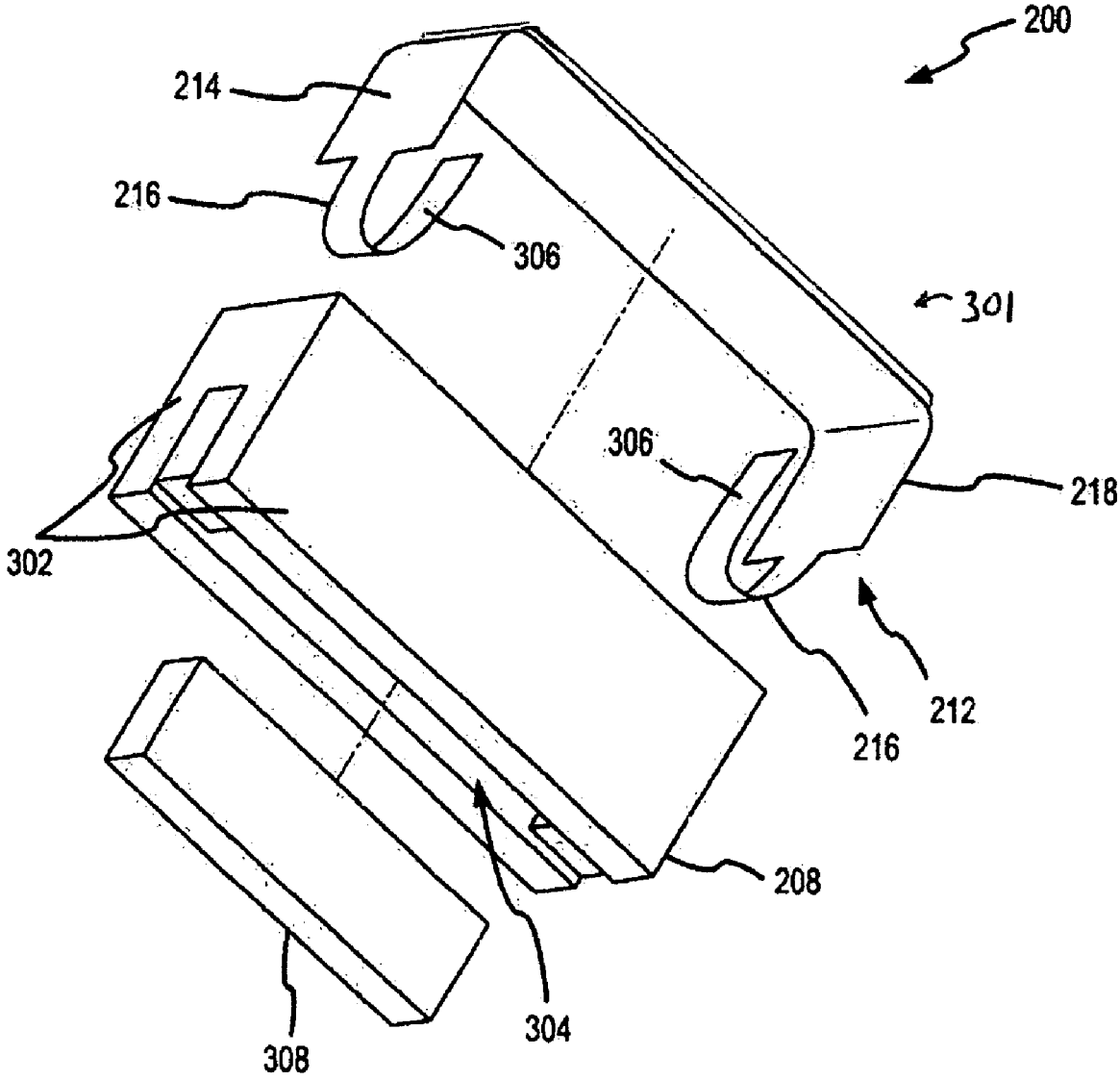
FIG. 3 shows a bottom perspective, exploded view of the antenna of FIG. 2.

Referring now to FIG. 3, a exploded view of antenna 200 is shown. Antenna 200. As shown in FIG. 3, carrier 208, having a planar F conductive trace in this example, has a plurality of sidewalls 302 defining a recess 304 internal to the carrier. Recess 304 is shown as having the same overall shape as carrier 208, but recess 304 may have shapes other than rectangular, such as, for example, elliptical or circular, square, trapezoidal, oblong, etc. or even a random shape. Hooks 216 traverse sidewalls 302 and a portion 306 extends into recess 304.

A locking clip 308 sized to frictionally fit into recess 304 captures portion 306 between an outside surface 310 of locking clip 308 and an inside surface 312 of sidewalls 302.

Locking clip 308 locks conductive trace 202 in place on carrier 208. As shown in FIG. 4, antenna 200 is placed on substrate 402. Because locking clip 308 locks conductive trace 202 in place, the leads are aligned with the power connections on the substrate, such that the electrical connection can be made by a solder connection. The placement also is secured in the event the adhesive 220 breaks down.

Locking clip 308 can be comprised of various plastic or ceramic materials. The actual choice of material would largely depend on the antenna characteristics desired as selected a higher or lower dielectric material, higher or lower loss material, etc. for locking clip 308 may alter the performance characteristics of antenna 308. Thus, locking clip 308 may be used, in part, to tune the operation of antenna 200.

Figure 5:
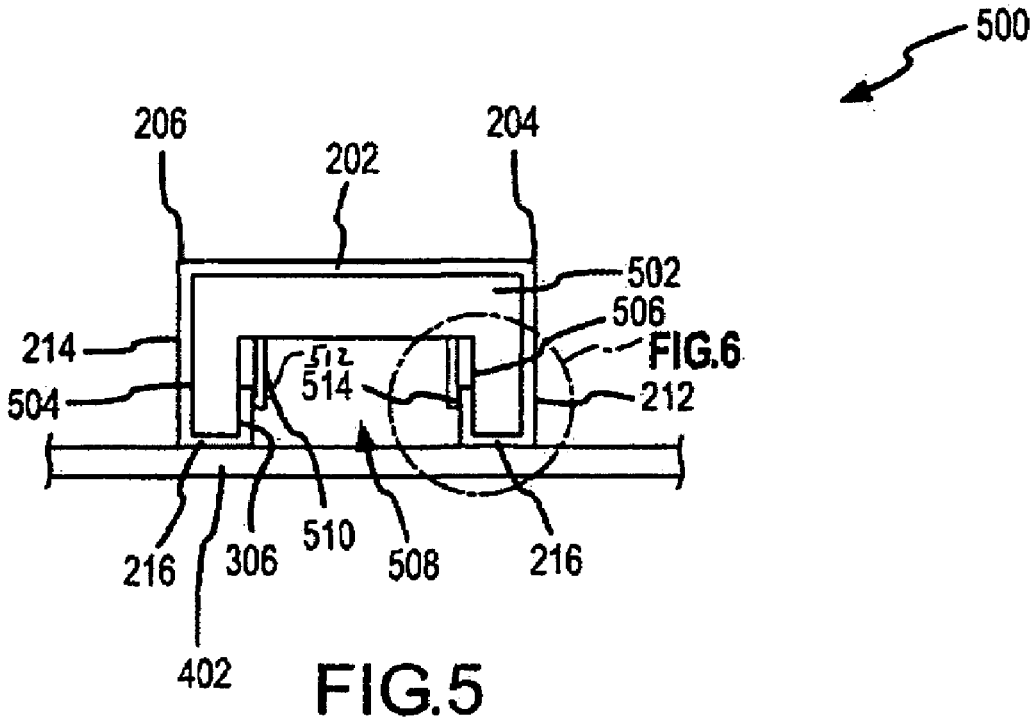
FIG. 5 shows a cross-sectional view of an antenna constructed in accordance with another embodiment of the present invention.

Carrier 208 and locking clip 308 function well to lock conductive trace 202 and provide stability to allow antenna 200 to be soldered at, for example, solder points 201 onto substrate 402. Referring now to FIG. 5, an alternative antenna 500 is shown. Antenna 500 includes many identical features of antenna 200, which features will not be re-explained herein. Essentially, antenna 500 comprises conductive trace 202 having first end 204 and second end 206 opposite the first end. Flexible film 218 and adhesive layer 220 has been omitted for clarity, but is optionally included to, at least, temporality secure conductive trace 202 on a carrier 502. First lead 212 and second lead 214 extend from first end 204 and second end 206 along a sidewall 504 of carrier 502. Leads 212 and 214 terminate in hooks 216 that traverse sidewall 504. Portion 306 extends along an inside surface 506 of sidewall 504 into a recess 508 defined by sidewall 504. Elastic members 510 residing in recess 508 extend from inside surface 506 toward substrate 402. Elastic members 510 provide a force tending to force portion 306 into inside surface 506 causing a frictional engagement between portion 306 and inside surface 506 to lock portion 306, leads 212 and 214, and conductive trace 202 in place on carrier 502. As shown, portion 306 may include a protrusion 512 at a distal end. Protrusion 512 may mate with a corresponding protrusion 514 at a distal end of elastic member 510. Thus, elastic members 510 act as a spring lock or clip. The above is shown in more detail by the blown up view as indicated by detail 6.

Figure 6:
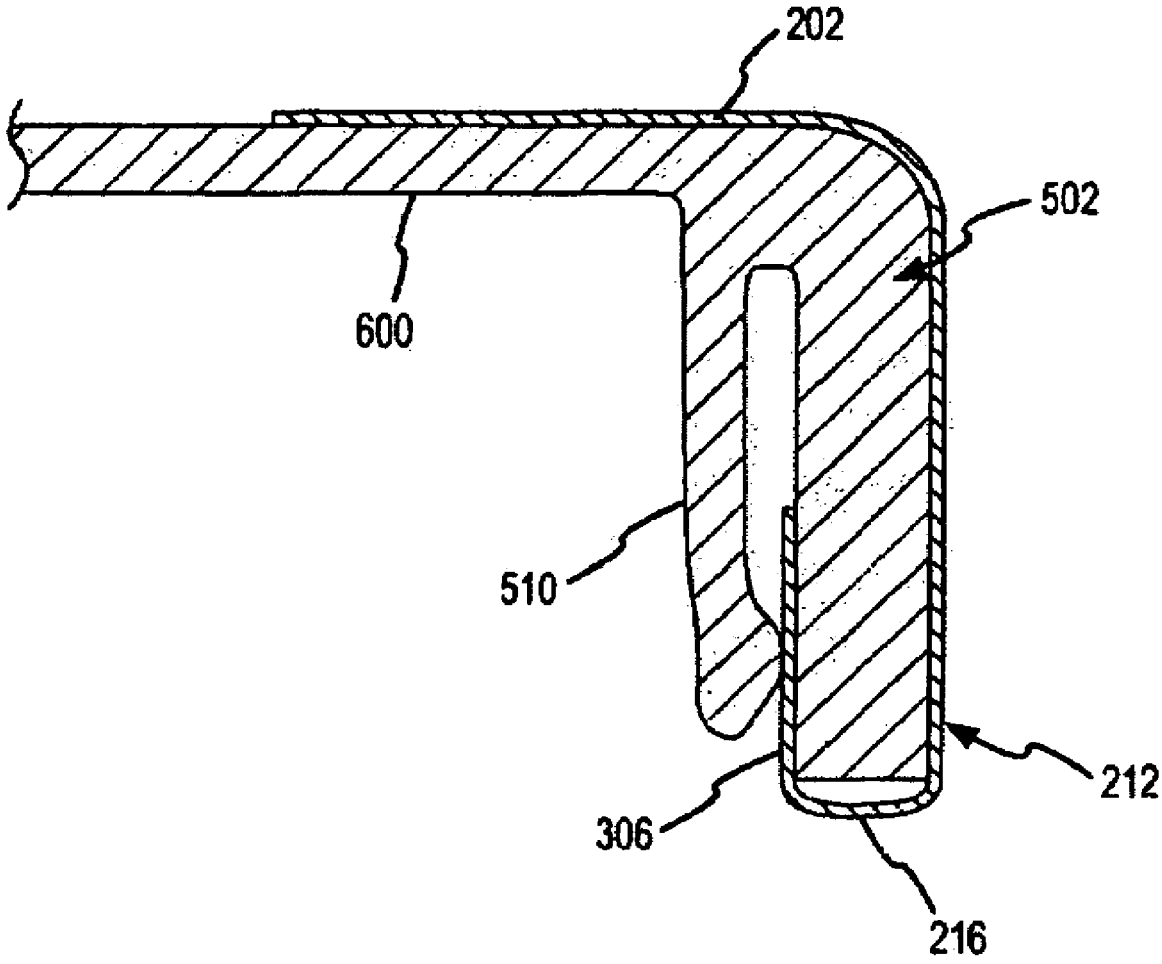
FIG. 6 shows an alternative configuration for the elastic members of FIG. 5.

FIG. 6 shows an alternative connection for the elastic members 510. The construction in FIG. 5 shows the elastic members 510 coupled to inside surface 506. In FIG. 6, elastic members 510 extend from a top surface 600 of recess 508.

While the invention has been particularly shown and described with reference to embodiments thereof, it will be understood by those skilled in the art that various other changes in the form and details may be made without departing from the spirit and scope of the invention.

The invention claimed is:

1. An antenna to mount on a substrate contained in a wireless device, the antenna comprising:

a carrier;

the carrier comprises a at least one sidewall having an inside surface defining an internal recess;

a conductive trace residing on the carrier;

the conductive trace having a first end and a second end opposite the first end;

at least one lead;

the at least one lead coupled to the first end or the second end of the conductive trace and extending from the conductive trace along the sidewall;

at least one hook;

the at least one hook corresponding to the at least one lead, the at least one hook traversing the sidewall and having a portion extending along the inside surface of the internal recess;

a locking clip; and the locking clip sized to fit in the internal recess and frictionally lock the portion between an outside surface of the locking clip and the inside surface of the internal recess, wherein the locking clip locks the portion, the at least one hook, the at least one lead, and the conductive trace in position on the carrier.

2. The antenna according to claim 1, wherein the conductive trace comprises a meanderline antenna.

3. The antenna according to claim 1, further comprising a flexible film, the flexible film residing between the conductive trace and the carrier.

4. The antenna according to claim 1, further comprising alignment device to align the carrier with a substrate.

5. The antenna according to claim 4, wherein the substrate is a printed circuit board.

6. The antenna according to claim 1, wherein the carrier comprises a substantially rectangular shape.

7. The antenna according to claim 1, wherein the carrier comprises a substantially elliptical shape.

8. The antenna according to claim 1, further comprising an adhesive between the conductive trace and the carrier.

9. The antenna according to claim 1, further comprising a film and an adhesive, wherein the conductive trace resides on the film and the film is adhered to the carrier by the adhesive.

10. The antenna according to claim 1, wherein the locking clip is a material selected from the group of materials consisting of: plastics or ceramics.

11. The antenna according to claim 10, wherein the material is selected to be a relatively high dielectric material.

12. The antenna according to claim 10, wherein the material is selected to be a relatively low dielectric material.

13. The antenna according to claim 10, wherein the material is selected to be a low loss material.

14. The antenna according to claim 1, wherein the conductive trace comprises a planar inverted F antenna.

15. A wireless device, the wireless device comprising:

a substrate, the substrate having a plurality of electronics, an antenna coupled to the substrate, the antenna comprising:

a carrier, the carrier comprising a plurality of sidewalls having an inside surface defining an internal recess, a conductive trace residing on the carrier, a plurality of leads, each of the plurality of leads traversing at least one of the plurality of sidewalls coupling the plurality of electronics to the conductive trace;

each of the plurality of leads terminating in a hook that traverses the sidewall such that a portion of the hook extends along the inside surface into the internal recess; and a locking clip fit into the internal recess, the locking clip having an outside surface to frictionally engage the portion between the inside surface and the outside surface.

16. The wireless device according to claim 15, wherein the plurality of leads coupling the plurality of electronics to the conductive trace further comprises at least one solder connection.

17. The wireless device according to claim 15, wherein the substrate comprises a printed circuit board.

18. An antenna to mount on a substrate contained in a wireless device, the antenna comprising:

a carrier;

the carrier comprises a at least one sidewall having an inside surface defining an internal recess;

a conductive trace residing on the carrier;

the conductive trace having a first end and a second end opposite the first end;

at least one lead;

the at least one lead coupled to the first end or the second end of the conductive trace and extending from the conductive trace along the sidewall;

at least one hook;

the at least one hook corresponding to the at least one lead, the at least one hook traversing the sidewall and having a portion extending along the inside surface of the internal recess;

at least one elastic member; and the at least one elastic member coupled to the inside surface of the internal recess, wherein the at least one elastic member abuts the portion tending to seat the portion against the inside surface of the internal recess.

19. The antenna according to claim 18, further comprising at least one protrusion formed at a distal end of the portion.

20. The antenna according to claim 19, further comprising at least one protrusion formed at a distal end of the at least one elastic member to engage the at least one protrusion formed at the distal end of the portion.

21. An antenna to mount on a substrate contained in a wireless device, the antenna comprising:

a carrier;

the carrier comprises a at least one sidewall having an inside surface defining an internal recess;

a conductive trace residing on the carrier;

the conductive trace having a first end and a second end opposite the first end;

at least one lead;

the at least one lead coupled to the first end or the second end of the conductive trace and extending from the conductive trace along the sidewall;

at least one hook;

the at least one hook corresponding to the at least one lead, the at least one hook traversing the sidewall and having a portion extending along the inside surface of the internal recess;

at least one elastic member, the, at least one elastic member coupled to the carrier and extending into the internal recess, wherein the at least one elastic member fictionally locks the portion between the at least one elastic member and the inside surface of the internal recess such that the portion, the at least one hook, the at least one lead, and the conductive trace are locked in a fixed position on the carrier.

22. The antenna according to claim 21, wherein the at least one elastic member extends from an inside surface of the internal recess.

23. The antenna according to claim 21, wherein the at least one elastic member extends from a top surface of the internal recess.

24. The antenna according to claim 21, further comprising a protrusion at a distal end of the at least one elastic member.

25. The antenna according to claim 24, further comprising a protrusion at a distal end of the portion.

* * * * *